US007000327B2

(12) United States Patent
Rager

(10) Patent No.: US 7,000,327 B2
(45) Date of Patent: Feb. 21, 2006

(54) COMPENSATOR BOW SIGHT

(75) Inventor: Christopher A. Rager, Bozeman, MT (US)

(73) Assignee: Trophy Ridge, LLC, Belgrade, MT (US)

( * ) Notice: Subject to any disclaimer, the term of this patent is extended or adjusted under 35 U.S.C. 154(b) by 0 days.

(21) Appl. No.: 10/661,918

(22) Filed: Sep. 12, 2003

(65) Prior Publication Data

US 2004/0111900 A1 Jun. 17, 2004

Related U.S. Application Data

(60) Provisional application No. 60/410,877, filed on Sep. 13, 2002.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 3,234,651 | A | * | 2/1966 | Rivers | 33/265 |
| 4,120,096 | A | * | 10/1978 | Keller | 33/265 |
| 4,580,349 | A | * | 4/1986 | Webb et al. | 33/265 |
| 4,616,422 | A | | 10/1986 | Gaddy | |
| 4,711,036 | A | | 12/1987 | Morris | |
| 4,720,919 | A | | 1/1988 | Saunders | |
| 4,796,364 | A | | 1/1989 | Amacker | |
| 4,846,141 | A | * | 7/1989 | Johnson | 124/87 |
| 4,884,347 | A | * | 12/1989 | Larson | 33/265 |
| 4,967,478 | A | * | 11/1990 | Sherman | 33/265 |
| 5,086,567 | A | * | 2/1992 | Tutsch | 33/265 |
| 5,103,568 | A | * | 4/1992 | Canoy | 33/265 |
| 5,121,547 | A | | 6/1992 | Littlejohn | |
| 5,131,153 | A | * | 7/1992 | Seales | 33/265 |
| 5,253,423 | A | | 10/1993 | Sullivan, Jr. et al. | |
| 5,303,479 | A | | 4/1994 | Rudovsky | |
| 5,305,530 | A | | 4/1994 | Robertson, Jr. et al. | |
| 5,383,279 | A | * | 1/1995 | Tami | 33/265 |
| 5,388,336 | A | | 2/1995 | Pomaville | |
| 5,419,051 | A | * | 5/1995 | Barngrover | 33/265 |
| 5,465,491 | A | * | 11/1995 | Thell | 33/265 |
| 5,539,989 | A | | 7/1996 | Potter | |
| 5,560,113 | A | * | 10/1996 | Simo et al. | 33/265 |
| 5,634,278 | A | | 6/1997 | London | |
| 5,676,122 | A | * | 10/1997 | Wiseby et al. | 124/87 |
| 5,685,081 | A | * | 11/1997 | Winegar | 33/265 |
| 5,914,775 | A | | 6/1999 | Hargrove et al. | |
| 6,145,208 | A | | 11/2000 | Savage | |
| 6,199,286 | B1 | | 3/2001 | Reed, Jr. et al. | |
| 6,418,632 | B1 | | 7/2002 | Kalfayan | |
| 6,418,633 | B1 | | 7/2002 | Rager | |

(Continued)

*Primary Examiner*—G. Bradley Bennett
*Assistant Examiner*—Tania Courson
(74) *Attorney, Agent, or Firm*—Merchant & Gould P.C.

(57) ABSTRACT

A bow sight having a vertical pin and a sight point pivotally connected to the bow, the pin and sight point being vertically and laterally adjustable. The bow sight includes a structure, pivotal in relation to a bow handle. The pivotal structure may be pivotally connected to a stationary structure, which is fixedly attached or connected to a bow handle. The moveable nature of the pivotal structure provides compensation for changes in targeting distance due to changing the position of the bow. Additionally, various features provide vertical and lateral adjustment of the sight points. The bow sight of the present invention accommodates for changes in shooting angle without having to manually readjust the sight points.

21 Claims, 2 Drawing Sheets

U.S. PATENT DOCUMENTS 6,430,821 B1 8/2002 Cionni
6,560,884 B1 5/2003 Afshari
6,725,854 B1 4/2004 Afshari
2004/0006879 A1 1/2004 Afshari
2004/0088871 A1 5/2004 Afshari

* cited by examiner

COMPENSATOR BOW SIGHT

CROSS REFERENCE TO RELATED APPLICATION

This application claims priority under 35 U.S.C. § 119(e) to U.S. provisional application Ser. No. 60/410,877, filed Sep. 13, 2002 and entitled "Pendulum Bow Sight". The entire disclosure of 60/410,877 is incorporated by reference.

FIELD OF THE INVENTION

This invention relates to archery equipment and more particularly to a sighting apparatus for use with an archery bow, generally referred to as a bow sight. In particular, the bow sight of this invention provides vertical sighting compensation.

BACKGROUND OF THE INVENTION

Many bow sight designs and configurations are known. Bow sights generally have multiple sight points used when shooting arrows at targets positioned at different distances from the archer. Many bow sights include multiple sight points attached to horizontal pins; examples of such bow sights are shown, for example, in U.S. Pat. Nos. 5,103,568; 5,676,122; and 5,685,081. A more recent development has been a bow sight with vertical pins. An example of a bow sight having vertical pins and a fiber optic sight point at the end of the pins is shown, for example, in U.S. Pat. No. 6,418,633. A number of U.S. patents disclose bow sights having various other arrangements of sight points. See, for example, U.S. Pat. Nos. 3,234,651; 4,120,096; 5,086,567; and 5,131,153. Each of these designs is intended to provide a sight point for a set target distance. When the bow is shot at a non-horizontal angle (such as uphill or downhill), using the same distance sight point, the resulting shot will be off target.

What is needed is bow sight to compensate for target distance variation caused by changing the shooting angle of the bow.

SUMMARY OF THE INVENTION

The invention is directed to a bow sight having a sight point pivotally connected to the bow. Tilting or angling of the bow causes pivoting of the sight point, which compensates for the distance change due to the angled shot.

The bow sight generally includes a pivotal structure, pivotal in relation to a bow handle. The pivotal structure may be pivotally connected to a stationary structure, which is fixedly attached or connected to a bow handle. The moveable nature of the pivotal structure provides compensation for changes in targeting distance due to changing the position of the bow. Additionally, various features provide vertical and lateral adjustment of the sight points. The bow sight of the present invention accommodates for changes in shooting angle without having to manually readjust the sight points.

In one particular embodiment, the invention is directed to a bow sight comprising a portion that is pivotally connectable to the bow. This pivotal portion includes at least one pin connected to the portion, with the pin defining a sight point. Also included is a pin adjustment mechanism operably connected to the at least one pin for moving the pin sight point vertically, and a lateral pin adjustment mechanism operably connected to the pin for moving the pin sight point laterally. In one preferred embodiment, the at least one pin is a vertical pin.

In another particular embodiment, the invention is directed to a bow sight comprising a first portion configured for attachment to the bow and a second portion pivotally connected to the first portion about an axis to allow lateral pivotal movement of the second portion in relation to the first portion. The bow sight also has at least one pin connected to the second portion, and a pin adjustment mechanism operably connected to the at least one pin for moving the pin sight point vertically, and a lateral pin adjustment mechanism operably connected to the at least one pin for moving the pin sight point laterally. In one preferred embodiment, the at least one pin is a vertical pin.

Any of the bow sights of the present invention may have a single pin or have multiple pins, such as three or five. Vertical pins are preferred, and vertical pins, extending downward and having their sight point at the pin's lowermost point, are most preferred. The end of a fiber optic cable can be used as the sight point.

The present invention is also directed to a method of targeting. One particular method of targeting includes providing a bow sight that has a first portion and a second portion pivotally connected to the first portion about an axis to allow lateral pivotal movement of the second portion in relation to the first portion. The bow sight also has at least one pin defining a sight point connected to the second portion, a pin adjustment mechanism operably connected to the at least one pin for moving the pin sight point vertically, and a lateral pin adjustment mechanism operably connected to the at least one pin for moving the pin sight point laterally. Using the bow sight, targeting an object by vertically adjusting the sight point, the object being at a set distance, and then pivoting the second portion about the axis and targeting a second objection at the set distance by laterally adjusting the sight point.

These, and additional embodiments of the invention, are described below.

DETAILED DESCRIPTION OF THE PREFERRED EMBODIMENT

In the following description of preferred embodiment, reference is made to the accompanying drawings, which form a part hereof, and in which is shown, by way of illustration, specific embodiments in which the invention may be practiced. It is to be understood that other embodiments may be utilized and structural changes may be made without departing from the scope of the present invention.

Figure 1:
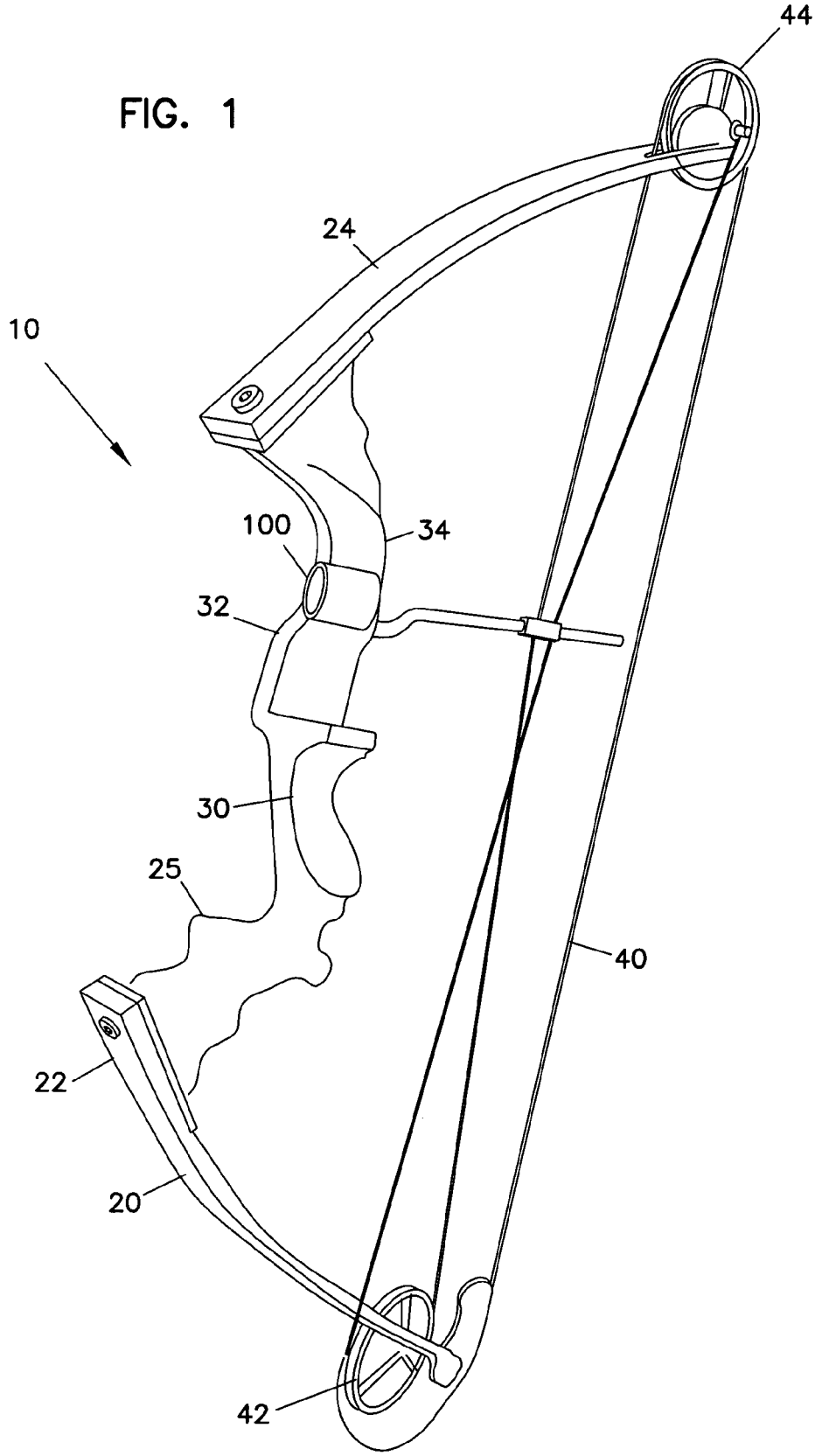
FIG. 1 is a is a perspective view of a bow incorporating a bow sight.

Referring now to the figures, wherein like features are referenced with like numerals, a bow 10 is shown in FIG. 1. Bow 10 has a frame 20 and a string 40. Frame 20 includes a lower portion or arm 22, an upper portion or arm 24, and a handle portion 25 with a grip 30 connected to and supporting lower arm 22 and upper arm 24. Handle 25 has a front surface 32 and an opposite back surface 34. During shooting with the bow, front surface 32 is positioned facing the target and back surface 34 is facing the archer.

Bow 10 is illustrated as a compound bow, with pulley or cam 42 at the end of lower arm 22 and pulley or cam 44 at the end of upper arm 24. A bowstring 40 extends between cam 42 and cam 44. Cams 42, 44 provide a mechanical advantage to the archer when drawing bowstring 40. Although not illustrated, a peep sight may be positioned on bowstring 40 to facilitate targeting and aiming.

Mounted on handle 25 of bow 10 is a bow sight 100, which facilitates targeting; that is, bow sight 100 provides a means for judging position and distance to a target.

Figure 2:
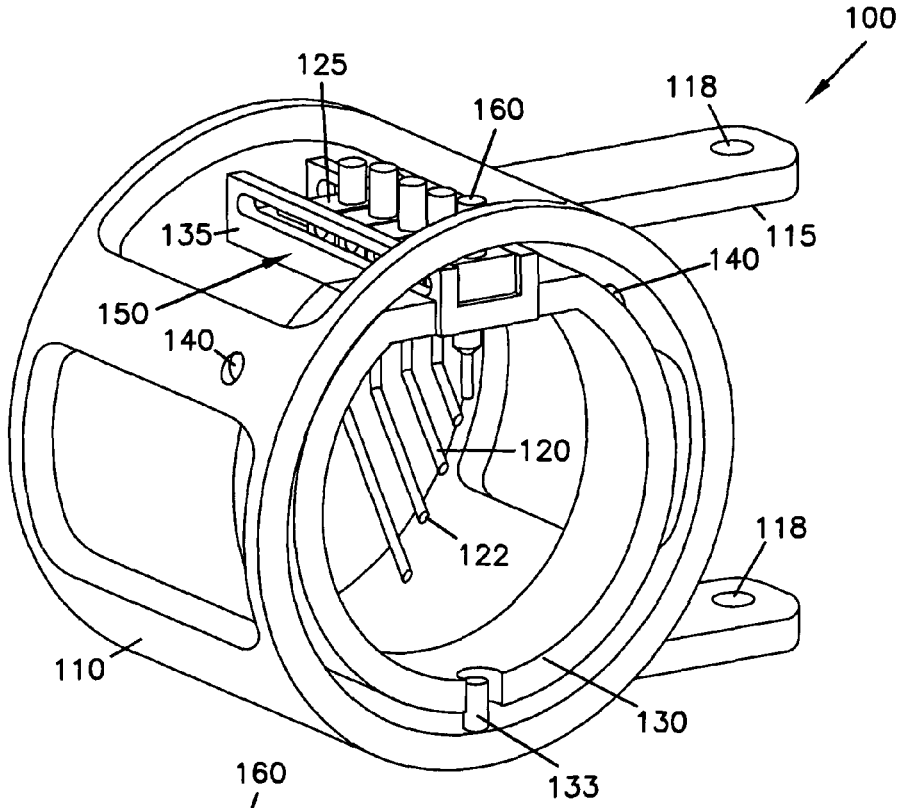
FIG. 2 is a perspective view of a bow sight according to the present invention.
Figure 3:
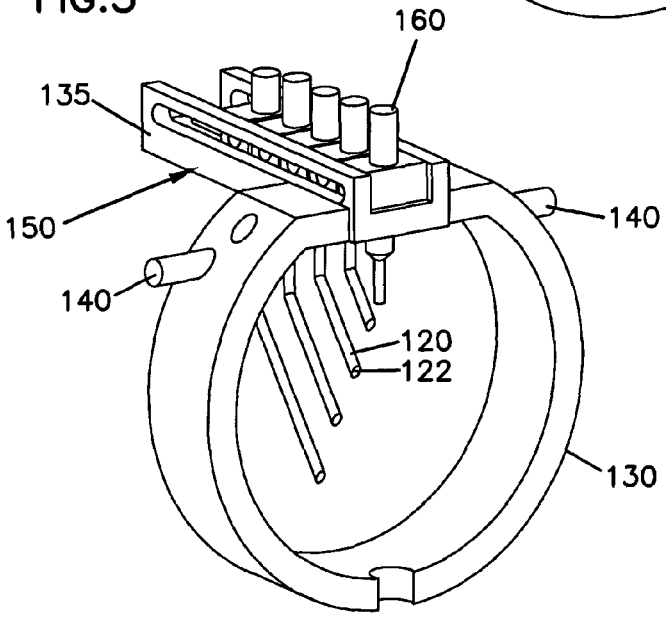
FIG. 3 is a perspective view of a portion of the bow sight of FIG. 2.
Figure 4:
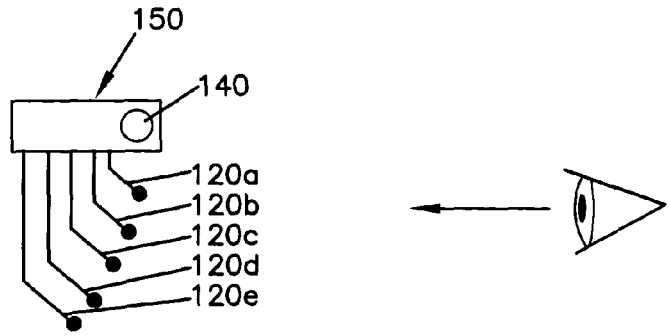
FIG. 4 is a schematic representation of five sight pins in relation to a shooter.

Referring to FIGS. 2, 3, and 4, a preferred embodiment of a bow sight is illustrated as bow sight 100. For purposes of this application, the view of the bow sight as seen from the archer in the shooting position, which is the view illustrated in FIG. 2, is referred to as the "front view" of the bow sight. In the schematic rendition of FIG. 4, the archer is looking toward the front of the sight. When the bow sight is mounted on a bow and held in a shooting position, the axis of the bow sight horizontal to the ground, in the plane of the front view and parallel to that plane, is considered the "lateral" direction. The axis of the bow sight, perpendicular to the ground, is considered "vertical". When bow sight 100 is properly mounted on handle 25 and bow 10 is held horizontal, the lateral direction will be generally horizontal extending towards and away from the archer.

Bow sight 100 generally includes a stationary portion and a second portion pivotally mounted to the stationary portion, which is fixedly mounted to bow handle 25. The moveable nature of the pivotal portion provides compensation for changes in targeting distance due to changing the position of the bow. For example, a target at 20 yards, when shooting horizontal, will appear to be less (for example, 15 yards), when shooting downward at the target, for example, from a tree stand. Bow sight 100 accommodates for changes in shooting angle without having to readjust the sight points for distance.

Bow sight 100 includes a housing or support structure 110 for mounting bow sight 100 to bow handle 25. Extending from structure 110 are brackets 115 having apertures 118 therein, for mounting sight 100 to bow handle 25 with screws or other attachment means.

In a preferred embodiment, support structure 110 is a generally circular shaped piece of material, such as acrylic, polycarbonate, or other plastic, aluminum, or the like. Other examples of suitable support structure shapes include square, elliptical, and oblong. Housing support structure 110 may be composed of multiple sections or pieces that together form the support structure. Housing support 110 may be solid, or may include various perforations or apertures, to lighten bow sight 100, to facilitate movement of various parts of bow sight 100, or to allow more light to enter bow sight 100.

Pivotally attached to housing support structure 110 is a plurality of sight pins 120, each pin 120 defining a sight point 122. In the embodiment illustrated, sight pins 120 are movably attached to a sight window 130, which is pivotally attached to support structure 110 at pivot axis 140. Pivot axis 140 extends generally horizontal to the ground and perpendicular to bow handle 25, so that pivoting of sight window 130 around pivot axis 140 produces lateral swinging movement of window 130 away from support structure 110 and the archer. It is preferred that sight window 130 encompasses and encircles pins 120 at least partially, so that pins 120 are positioned within window 130. Similarly, it is preferred that support structure 110 encompasses and encircles sight window 130 at least partially. Housing support 110 and sight window 130 are shaped and sized so that sight window 130 can pivot within support structure 110 around pivot axis 140. A stop may be positioned on housing 110, on window 130, or both, to inhibit the movement of window 130 in relation to support 110. In the embodiment illustrated, a bumper stop 133 extends from housing support structure 11O to limit window 130 from swinging forward of support structure 110. Window 130 includes a notch to accept stop 133.

Sight pins 120 support or otherwise define sight points 122, which the archer uses for targeting an object. Sight point 122 may be integral with pin 120 or be a separate piece from pin 120. A sight or sighting point is any shape, point, or indicia of any sort that is visually placed in line with the target to be shot at for assisting in the proper aiming of the bow. Sight points 122 can be circular shapes, other geometrical shapes, colored dots, the end of a light gathering cable, or simply the end of sight pin 120, for example. Although five pins 120 and their respective sight points 122 are illustrated in the figures, it is understood that any number of pins 120 and sight points 122 can be utilized; in most embodiments, however, at least two pins 120 will be present. Pins 120 may be straight or may be bent.

Pins 120 may be horizontal pins, meaning, when viewed by the archer in the shooting position, pins 120 extend from the left or right side of support housing 110 into the field of view. The preferred pins 120 for use with bow sight 100, however, are vertical pins, or, pins that have a vertical component so that at least a portion of the pin extends vertically. As used herein, a pin is considered a vertical pin if the pin has a vertical portion. Additionally, in a preferred embodiment, multiple pins are positioned so that they are aligned when viewed by the archer in the shooting position. The benefit of vertical aligned pins is discussed, for example, in U.S. Pat. No. 6,418,633, which is incorporated herein by reference. Preferably, when multiple vertical pins are aligned, the archer is able to view the sight point of each pin, but only views the widest-most pin.

In a preferred embodiment, sight pin 120 is a rigid pin supporting sight point 122. An end of a fiber optic cable may be positioned at the end of sight pin 120 to act as sight point 122. The fiber optic cable collects light along its length, and the light exits the end of the cable forming sight point 122. The fiber optic cable may be held in place by a slit or other aperture located near the end of pin 120.

As stated above, pins 120 are preferably movably attached to sight window 130, although in some embodiments, the entire pin 120 is not moveable, but sight points 122 are moveable in relation to sight window 130. In the embodiment illustrated, pins 120 are held by structure 150. Structure 150 includes various features that provide for vertical and lateral (front-to-back or horizontal) adjustment of sight points 122 of pins 120.

Vertical adjustment of sight points 122 is accomplished via vertical adjustment mechanism 160; in a preferred embodiment, vertical adjustment of sight point 122 is accomplished by vertical adjustment of pins 120. Vertical adjustment mechanism 160 can be any structure that allows movement of and then locks sight point 122 in relation to structure 150. Examples of suitable mechanism 160 include set screws, geared cams, and locking cams. The vertical position of pin 120 and sight point 122, that is, the distance pin 120 and sight point 122 depends, provides the distance to the target.

Lateral, or front-to-back, adjustment is accomplished via a lateral adjustment configuration that moves sight points 122 laterally. A preferred embodiment for a lateral adjustment configuration includes sliders 125 housed within a slider casing 135. Sliders 125 and casing 135 allow front-to-back adjustment of pins 120 in relation to sight window 130; that is, sliders 130 and casing 135 allow pins 120 to be moved farther from and closer to the archer. Each pin 120 is attached to slider 125, which is movable within slider casing 135. A set screw, locking cam, or other such mechanism can be used to move and lock slider 125 and pin 120 in relation to casing 135. Access to the locking mechanism can be gained through a slot or other structure in casing 135. The lateral position of pin 120 and sight point 122, that distance of pin 120 and sight point 122 from the eye of the archer, compensates for different shooting angles. That is, the lateral position of sight point 122 is adjusted so that the same position of sight point 122 provides a set target distance (for example, 20 yards) whether shooting flat or angled.

Referring to FIG. 4, a schematic representation of five sight pins, 120*a*, 120*b*, 120*c*, 120*d*, 120*e* in relation to pivot axis 140 is illustrated. Sight pins 120*d*, 120*e*, for example, those used to aim at further distances (such as 50 yards and 60 yards, for example) are set further behind pivot axis 140 than the close yardage pins. That is, sight pins 120*d*, 120*e* are further from the archer's eye and further from pivot axis 140 than pins 120*a*, 120*b*, etc. The further distance from axis 140 causes the sight points of pins 120*d*, 120*e* to lift faster than the close yardage pins, enabling the proper pin lift needed for each distance. The speed and amount of lift of the pins and sight points is directly proportional to the distance from axis 140.

Support structure 110 may include a dampening system to reduce vibration caused when bowstring 40 is released. An example of a suitable dampening system includes a material that is softer than the material that makes up the part of bow handle 25 to which the device is directly attached, such that the dampening system at least partially absorbs the vibrations caused by the release of bowstring 40 when shooting an arrow. Dampening systems are described, for example, in U.S. Pat. No. 6,418,633, which is incorporated herein by reference.

The materials for bow sight 100 can include metals (e.g., aluminum, steel, brass), plastics (e.g., polycarbonate, acrylics), and ceramics and composite materials. Such materials can be used for any of support structure 110, mounting bracket 115, sight window 130, and any other portion of bow sight 100. Pins 120 are preferably a rigid material, such as metal. Any or all of these pieces may include a coating thereon.

To use bow sight 100, an archer would first mount bow sight 100 onto bow handle 25 via mounting brackets 115. The shortest yardage pin (typically a 20 yard pin) is vertically positioned to provide accurate flat targeting; that is, pin 120*a* (FIG. 4) would be positioned using vertical adjustment mechanism 160 so that the sight point 122 is aligned with a target when aimed flat or horizontal to the ground. Sight window 130 can be locked in relation to housing support structure 110 for convenience while making this adjustment. After positioning sight point 122 while on flat ground, the vertical position of pin 120*a* need not be loosened or adjusted again. Once positioned, any locking mechanism is unlocked so that sight window 130 is free to pivot around axis 140 in relation to support structure 110 and bow handle 25.

The bow sight is then targeted on an object positioned on a slope, typically a downward slope. A downward slope of 30 to 45 degrees is typical for shooting from a tree stand. Angling the bow down will cause sight window 130 to swing down away from the archer. To target the bow on a slope, pin 120*a* and its sight point 122 are adjusted by sliding pin 120*a* laterally from front to back of bow sight 100 using slider 125 in casing 135. The vertical adjustment is not modified at this step.

After sighting on the slope, pin 120*a* will tightly track the optimal pin height for any angles, from 0 degrees (i.e., flat or horizontal) to about 45 degrees. When properly adjusted, bow sight 100, when tilted from 0 degrees to 33 degrees, is accurate within half a yard.

The above specification and examples provide a complete description of the manufacture and use of the invention. It is to be understood that other embodiments may be utilized and structural changes may be made without departing from the present invention. Although a bow sight has been described, the details of this invention can be incorporated into other projecting shooting applications and systems, such as sights for rifles and shotguns. Since many embodiments of the invention can be made without departing from the spirit and scope of the invention, the invention resides in the claims hereinafter appended.

What is claimed is:

1. A bow sight for use with a bow comprising:

(a) a pivot portion pivotally connectable to the bow comprising:

(i) at least one pin carried by the pivot portion, the pin including a sight point;

(ii) a first pin adjustment mechanism for moving the pin sight point vertically relative to the pivot portion; and (iii) a second adjustment mechanism for allowing the pin to move relative to the pivot portion in a direction towards or away from a target.

2. The bow sight according to claim 1, further comprising a stationary portion configured for attachment to the bow, the pivot portion pivotally attached to the stationary portion.

3. The bow sight according to claim 1, wherein the sight point comprises an end of a fiber optic cable.

4. The bow sight according to claim 1, wherein the at least one pin includes a first vertically extending pin.

5. The bow sight according to claim 4, further comprising:

a second vertically extending pin carried by the pivot portion, the second pin including a second sight point, wherein the second sight point is carried such that it can be moved relative to the pivot portion both vertically and in a direction towards or away from a target.

6. The bow sight according to claim 5, further comprising a third, a fourth and a fifth vertically extending pin connected to the pivot portion, each of the pins including a sight point.

7. The bow sight according to claim 6, wherein each of the five sight points include an end of a fiber optic cable.

8. A bow sight for attachment to a bow, comprising:

(a) a first portion configured for attachment to the bow;

(b) a second portion pivotally connected to the first portion such that the first portion and the second portion pivot away from each other when the bow is aimed downwardly;

(c) at least one pin connected to the second portion;

(d) a first pin adjustment mechanism for moving the pin vertically relative to the second portion; and (e) a second pin adjustment mechanism for allowing the pin to move relative to the second portion in a direction toward or away from the target.

9. The bow sight according to claim 8, wherein the at least one pin includes a vertical pin.

10. The bow sight according to claim 9, wherein the at least one pin includes a first pin, a second pin, and a third pin, and wherein each pin includes a sight point.

11. The bow sight according to claim 10, wherein the sight points include an end of a fiber optic cable.

12. The bow sight according to claim 9, wherein the first pin adjustment mechanism comprises a locking cam.

13. The bow sight according to claim 9, wherein the second pin adjustment mechanism comprises a set screw.

14. A method of targeting comprising:

(a) providing a bow sight comprising:

(i) a first portion and a second portion pivotally connected to the first portion such that the first portion and the second portion pivot away from each other when the bow is aimed downwardly;

(ii) at least one vertical pin carried by the second portion, the vertical pin including a sight point;

(iii) a first pin adjustment mechanism for moving the pin and sight point vertically relative to the second portion; and (iv) a second pin adjustment mechanism for moving the pin and sight point relative to the second portion towards or away from the target;

(b) targeting an object by adjusting the vertical position of the sight point relative to the second portion, the object being at a set distance; and (c) pivoting the second portion away from the first portion and targeting the second object at the set distance by adjusting the position of the sight point relative to the second portion in a direction towards or away from the target.

15. The method according to claim 14, wherein the step of pivoting the second portion comprises:

(a) pivoting the second portion by aiming downwardly from horizontal.

16. A bow sight for attachment to a bow, comprising:

(a) a first portion configured for attachment to the bow;

(b) a second portion pivotally connected to the first portion to allow the second portion to pivot away from the first portion when the bow is aimed downwardly;

(c) a pin carried by the second portion, the pin including a sight point; and (d) the pin being slidable relative to the second portion in a direction towards or away from the target wherein the pin comprises a vertically extending first pin and wherein the bow sight further comprising a second vertically extending pin carried by the second portion, the second pin being slidable relative to the second portion in a direction towards or away from the target.

17. The bow sight according to claim 16, further comprising a third vertically extending pin carried by the second portion, the third pin being slidable relative to the second portion in a direction towards or away from the target.

18. The bow sight according to claim 16, wherein the sight point includes an end of a fiber optic cable.

19. The bow sight according to claim 16, wherein the pins are arranged one behind the other in a common vertical plane.

20. The bow sight of according to claim 16, wherein each pin includes an end that is secured in a track.

21. A method of sighting a bow comprising:

sighting the bow for a horizontal shot by setting a vertical position of a sight point relative to a pendulum member; and sighting the bow for an angled shot by sliding the sight point relative to the pendulum member in a direction towards or away from the target while maintaining the vertical position of the sight point.

* * * * *